US008030564B2

(12) United States Patent
Komori et al.

(10) Patent No.: US 8,030,564 B2
(45) Date of Patent: Oct. 4, 2011

(54) METHOD FOR SELECTING AND RECOMMENDING CONTENT, SERVER, CONTENT PLAYBACK APPARATUS, CONTENT RECORDING APPARATUS, AND RECORDING MEDIUM STORING COMPUTER PROGRAM FOR SELECTING AND RECOMMENDING CONTENT

(75) Inventors: Akihiro Komori, Tokyo (JP); Yoichiro Sako, Tokyo (JP)

(73) Assignee: Sony Corporation, Tokyo (JP)

( * ) Notice: Subject to any disclaimer, the term of this patent is extended or adjusted under 35 U.S.C. 154(b) by 829 days.

(21) Appl. No.: 11/823,813

(22) Filed: Jun. 28, 2007

(65) Prior Publication Data

US 2008/0000344 A1 Jan. 3, 2008

(30) Foreign Application Priority Data

Jul. 3, 2006 (JP) ..... P2006-183270

(51) Int. Cl.
*G10H 1/00* (2006.01)

(52) U.S. Cl. ..... 84/610; 84/602; 84/615; 84/618

(58) Field of Classification Search ..... 84/610
See application file for complete search history.

(56) References Cited

U.S. PATENT DOCUMENTS

| | | | | |
|---|---|---|---|---|
| 7,081,579 | B2 * | 7/2006 | Alcalde et al. | 84/608 |
| 7,518,052 | B2 * | 4/2009 | Kourbatov | 84/609 |
| 2003/0000369 | A1 * | 1/2003 | Funaki | 84/609 |
| 2004/0206228 | A1 * | 10/2004 | Suzuki et al. | 84/615 |
| 2005/0120865 | A1 * | 6/2005 | Tada | 84/600 |
| 2005/0160901 | A1 * | 7/2005 | Suzuki et al. | 84/613 |
| 2006/0107822 | A1 * | 5/2006 | Bowen | 84/612 |
| 2007/0060446 | A1 | 3/2007 | Asukai et al. | |
| 2007/0261538 | A1 | 11/2007 | Takai et al. | |

FOREIGN PATENT DOCUMENTS

| | | | |
|---|---|---|---|
| EP | 1128358 | A1 | 8/2001 |
| EP | 1821309 | A1 | 8/2007 |

(Continued)

OTHER PUBLICATIONS

Katsuhiko Kaji et al., Aiming at the playlist as the communication media, FIT2005 No. 4 Information science and technology forum, Information science and technology letters, Japan, Information Processing Society of Japan, Aug. 22, 2005, vol. 4, pp. 115-118.

(Continued)

*Primary Examiner* — Elvin G Enad
*Assistant Examiner* — Christopher Uhlir
(74) *Attorney, Agent, or Firm* — Wolf, Greenfield & Sacks, P.C.

(57) ABSTRACT

A content selecting and recommending method includes a step of generating a log table using information sent as a log from each of a plurality of users' terminals, each user's state being classified into one of a plurality of state patterns, the log table including information indicating a correspondence between each of the state patterns and a piece of content played back in the case of the state pattern; and a step of receiving a content recommendation request which is sent from a requesting user's terminal and includes a state detection signal generated as a result of detection of the requesting user's state, selecting a piece of content, from the log table, appropriate for the requesting user's state indicated, and sending a recommendation of the selected piece of content to the requesting user's terminal.

15 Claims, 8 Drawing Sheets

FOREIGN PATENT DOCUMENTS

| | | | |
|---|---|---|---|
| EP | 1973114 | A1 | 9/2008 |
| EP | 1973115 | A1 | 9/2008 |
| JP | 10-055174 | A | 2/1998 |
| JP | 11-120198 | A | 4/1999 |
| JP | 2000-268047 | A | 9/2000 |
| JP | 3231482 | B2 | 9/2001 |
| JP | 2001-299980 | A | 10/2001 |
| JP | 2002-073831 | | 3/2002 |
| JP | 2002-278547 | A | 9/2002 |
| JP | 2003-084774 | A | 3/2003 |
| JP | 2003-173350 | | 6/2003 |
| JP | 2004-054023 | | 2/2004 |
| JP | 2004-113552 | | 4/2004 |
| JP | 2004-294584 | | 10/2004 |
| JP | 2005-010771 | A | 1/2005 |
| JP | 2005-156641 | | 6/2005 |
| JP | 2006-146980 | A | 6/2006 |
| WO | WO 2004/072767 | A2 | 8/2004 |

OTHER PUBLICATIONS

Katsuhiko Kaji et al., Online music piece recommendation system based on the annotation about situation and preference, The Information Processing Society of Japan memoir, Japan, Information Processing Society of Japan, Dec. 12, 2004, vol. 2004 No. 127, pp. 33-38.

* cited by examiner

FIG. 3

| | |
|---|---|
| STATE PATTERN 1 | MOVING TEMPO < 80 |
| STATE PATTERN 2 | 80 ≤ MOVING TEMPO < 90 |
| STATE PATTERN 3 | 90 ≤ MOVING TEMPO < 100 |
| STATE PATTERN 4 | 100 ≤ MOVING TEMPO < 110 |
| STATE PATTERN 5 | 110 ≤ MOVING TEMPO |

FIG. 4

| | |
|---|---|
| STATE PATTERN 1 | STATIONARY (SMALL-MOVEMENT) |
| STATE PATTERN 2 | MODERATE-MOVEMENT |
| STATE PATTERN 3 | LARGE-MOVEMENT |
| STATE PATTERN 4 | IN WHICH CAR CONTINUOUSLY |
| STATE PATTERN 5 | IN WHICH CAR IS ALMOST STATIONARY |

FIG. 6

| | |
|---|---|
| USER ID | A1234 |
| ACQUIRED DATE AND TIME | JUNE 18, 11:50:15 |
| WALKING TEMPO | 150 STEPS/MINUTE |
| TITLE | LET'S GO AT A QUICK PACE |
| PLAYBACK POSITION | 1 MIN 43 SEC FROM BEGINNING OF PIECE OF MUSIC |
| ARTIST NAME | TARO&JIRO |
| ALBUM TITLE | LET'S WALK TOGETHER |

FIG. 7

| WALKING TEMPO T (STEPS/MINUTE) | PIECE OF MUSIC | FREQUENCY OF OCCURRENCE | ACCOMPANYING INFORMATION |
|---|---|---|---|
| $T < 80$ | A | 2 | YES (#1) |
| | B | 1 | NO |
| | C | 5 | NO |
| $80 \leq T < 90$ | D | 10 | NO |
| $90 \leq T < 100$ | E | 7 | NO |
| | F | 2 | NO |
| $100 \leq T < 110$ | G | 5 | NO |
| $110 \leq T$ | B | 1 | YES (#2) |
| | G | 1 | NO |
| | H | 3 | NO |

FIG. 8

| STATE PATTERN | PIECE OF MUSIC | FREQUENCY OF OCCURRENCE | ACCOMPANYING INFORMATION |
|---|---|---|---|
| STATE PATTERN 1 | A | 2 | YES (#3) |
| | B | 1 | NO |
| | C | 5 | NO |
| STATE PATTERN 2 | D | 10 | NO |
| STATE PATTERN 3 | E | 7 | NO |
| | F | 2 | NO |
| STATE PATTERN 4 | G | 5 | NO |
| STATE PATTERN 5 | B | 1 | YES (#4) |
| | G | 1 | NO |
| | H | 3 | NO |

METHOD FOR SELECTING AND RECOMMENDING CONTENT, SERVER, CONTENT PLAYBACK APPARATUS, CONTENT RECORDING APPARATUS, AND RECORDING MEDIUM STORING COMPUTER PROGRAM FOR SELECTING AND RECOMMENDING CONTENT

CROSS REFERENCES TO RELATED APPLICATIONS

The present invention contains subject matter related to Japanese Patent Application JP 2006-183270 filed in the Japanese Patent Office on Jul. 3, 2006, the entire contents of which are incorporated herein by reference.

BACKGROUND OF THE INVENTION

1. Field of the Invention

The present invention relates to a method and a system for selecting and recommending content such as a piece of music in accordance with a user's request for recommending content (the term "a request for recommending content" will hereinafter be referred to as "a content recommendation request").

2. Description of the Related Art

Since a number of new pieces of content such as music (pieces of music) are produced on a daily basis and are enjoyable in a variety of situations such as while walking, jogging, playing sports, traveling by car, and resting, various methods have been proposed for recommending content such as pieces of music to users or selecting content at the users' end.

More specifically, Japanese Unexamined Patent Application Publication No. 2004-54023 discloses that each of a plurality of users carries a list of music recommendations, which he/she recommends, in his/her portable terminal unit, and the users' lists of music recommendations are exchanged among the users' portable terminal units. It also discloses that, in a portable terminal unit of one user, the other users' lists of music recommendations are collected to generate a collected list of music recommendations, and thus selection of a piece of music can be made on the basis of the number of users who have recommended each of the pieces of music.

Moreover, Japanese Unexamined Patent Application Publication No. 2003-173350 discloses that, as a content recommending service provided over the Internet, a service provider recommends content such as new pieces of music appropriate for a user on the basis of a watching and listening history of the user sent to the service provider.

In addition, Japanese Unexamined Patent Application Publication No. 2004-113552 discloses that a list of pieces of music at a tempo substantially the same as that of a user's walking is displayed on a display section, and the user can select a piece of music from the list to play back and the selected piece of music is played back such that the tempo of the piece of music accords with that of the user's walking.

SUMMARY OF THE INVENTION

According to a method disclosed in Japanese Unexamined Patent Application Publication No. 2004-54023, a piece of music that is appropriate for a user's situation at a point in time is not recommended to the user on every occasion because, although selection of the piece of music is made from among the music recommendations of other users, the music recommendations are provided from the other users only as lists of recommended pieces of music. Similarly, according to a method disclosed in Japanese Unexamined Patent Application Publication No. 2003-173350, a piece of music that is appropriate for a user's situation at a point in time is not recommended to the user on every occasion.

Furthermore, according to a method disclosed in Japanese Unexamined Patent Application Publication No. 2004-113552, although a list of pieces of music at a tempo substantially the same as that of a user's walking is displayed, the user selects a piece of music from the list of pieces of music without an appropriate standard for selection; therefore, the user may get confused about selecting a piece of music.

Relations between a user's situation and a piece of music are, for example, (1) the probability is high that users walking or jogging at a similar tempo are likely to listen to similar pieces of music; (2) the probability is high that if some users tend to agree that a piece of music is appropriate for walking or jogging at a particular tempo, other users will also agree; and (3) the probability is high that if a user effectively, for example, loses weight by walking or jogging in a tempo with a piece of music, the piece of music will also be effective for other users; in particular, a piece of music determined effective for a plurality of users tends to be effective for a number of users.

Furthermore, each user will often have a desire or a request to know what kind of pieces of music other users are listening to or listen to according to a particular situation if they are in the same situation as the user, regardless of whether the user is walking, jogging, or in another situation, and to listen to the same pieces of music as other users to have a feeling of empathy or togetherness.

Therefore, it is desirable to select and recommend content appropriate for a user to listen to at a point in time in response to the user's request made on the basis of a type of content, which users are watching or listening to, or on the basis of information of a type of content, which users are watching or listening to, in a certain situation. In addition, it is also desirable to support the formation of a community among a great number of users based on content such as pieces of music.

According to an embodiment of the present invention, there is provided a method for selecting and recommending a piece of content. The method has a first step of generating a log table in the case where, for each of a plurality of users, information indicating a state of the user upon playback of a piece of content and information specifying the piece of content are received, both types of information being sent as a log from each user's terminal via a communication network, and each user's state is classified into one of a plurality of state patterns, the log table including information indicating a correspondence between each of the state patterns and a piece of content played back in the case of the state pattern; and a second step of receiving a content recommendation request which is sent from a requesting user's terminal via a communication network and includes a state detection signal generated as a result of detection of the requesting user's state, selecting a piece of content, from the log table, appropriate for the requesting user's state indicated in the state detection signal, and sending a recommendation of the selected piece of content to the requesting user's terminal.

In the above-described method for selecting and recommending a piece of content, for example, when a first user walks at relatively slow tempo, a piece of music which a second user frequently listened to or listens to when the second user walked or walks at a similar tempo is selected and recommended to the first user, and also when a first user rests, a piece of music which a second user frequently listened to or listens to when the second user rested or rests is selected and recommended to the first user.

As described above, according to the embodiment of the present invention, a piece of content appropriate for a user's state at a point in time can be selected and recommended in response to the user's request made on the basis of a type of content, which users are watching or listening to, or on the basis of information of a type of content, which users are watching or listening to, in a certain situation. In addition, the embodiment of the present invention can support the formation of a community among a great number of users based on content such as pieces of music.

BRIEF DESCRIPTION OF THE DRAWINGS

FIG. 3 is a table showing an example of patterns used for classifying a user's state;

FIG. 4 is a table showing another example of patterns used for classifying a user's state;

FIG. 6 is a table showing an example of a log;

FIG. 7 is an example of a log table when users' states are each classified into one of a plurality of patterns as shown in FIG. 3;

FIG. 8 is an example of a log table when users' states are each classified into one of a plurality of patterns as shown in FIG. 4.

DESCRIPTION OF THE PREFERRED EMBODIMENTS

1. System Configuration: FIGS. 1 through 4

Figure 1:
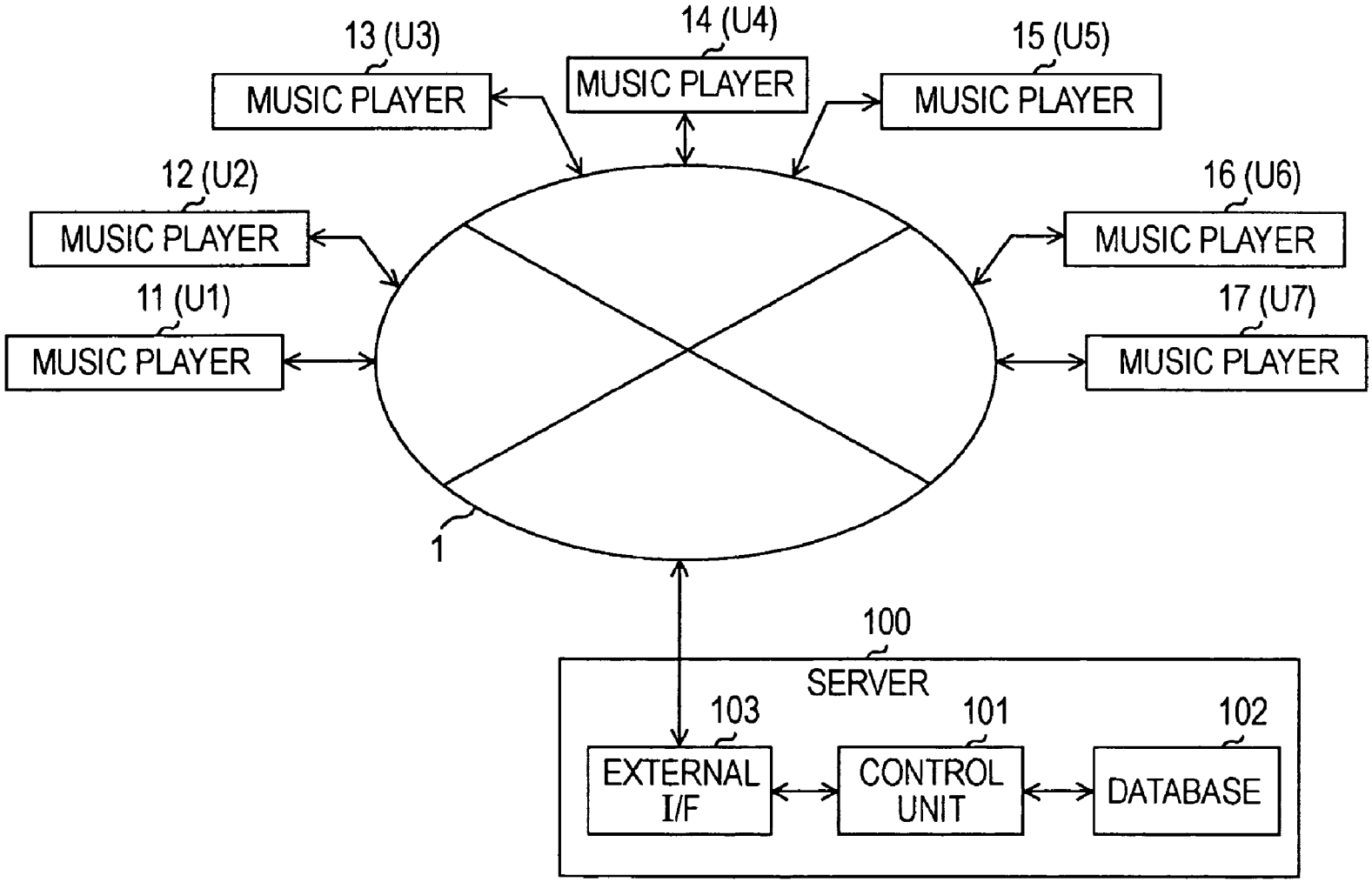
FIG. 1 is a block diagram of an example of a system according to an embodiment of the present invention.

1-1. General Information About System: FIG. 1

FIG. 1 shows an example of a system according to an embodiment of the present invention in a case where content is music (a piece of music).

The system of this example includes music players 11 through 17 of users U1 through U7, respectively, connected to a server 100 via the Internet 1.

FIG. 1 shows only seven users and seven music players for convenience; however, more users and music players may practically exist. Each of the music players may be any one of (A), (B) and (C) as follows.

(A) A system including an apparatus such as a portable music player, which can play back a piece of music using music data of the piece of music but does not have a function of accessing the Internet 1, and an apparatus such as a personal computer (PC) with a function of accessing the Internet 1.

(B) An apparatus such as a mobile telephone terminal or a portable music player, which can play back a piece of music using music data of the piece of music and has a function of accessing the Internet 1.

(C) A stationary (home use) apparatus, which can play back a piece of music using music data of the piece of music and has a function of accessing the Internet 1.

Each of the music players, more specifically, each of the users can be either on a side of recommending a piece of music by sending a log as described below or on a side of receiving a piece of music recommended from the server 100.

The server 100 includes a control unit 101, a database 102, and an external interface 103, which are connected to the control unit 101. The server 100 provides a community formed according to users' interests such as sports, dieting, health, or the like as a Web service on a Web site.

Figure 2:
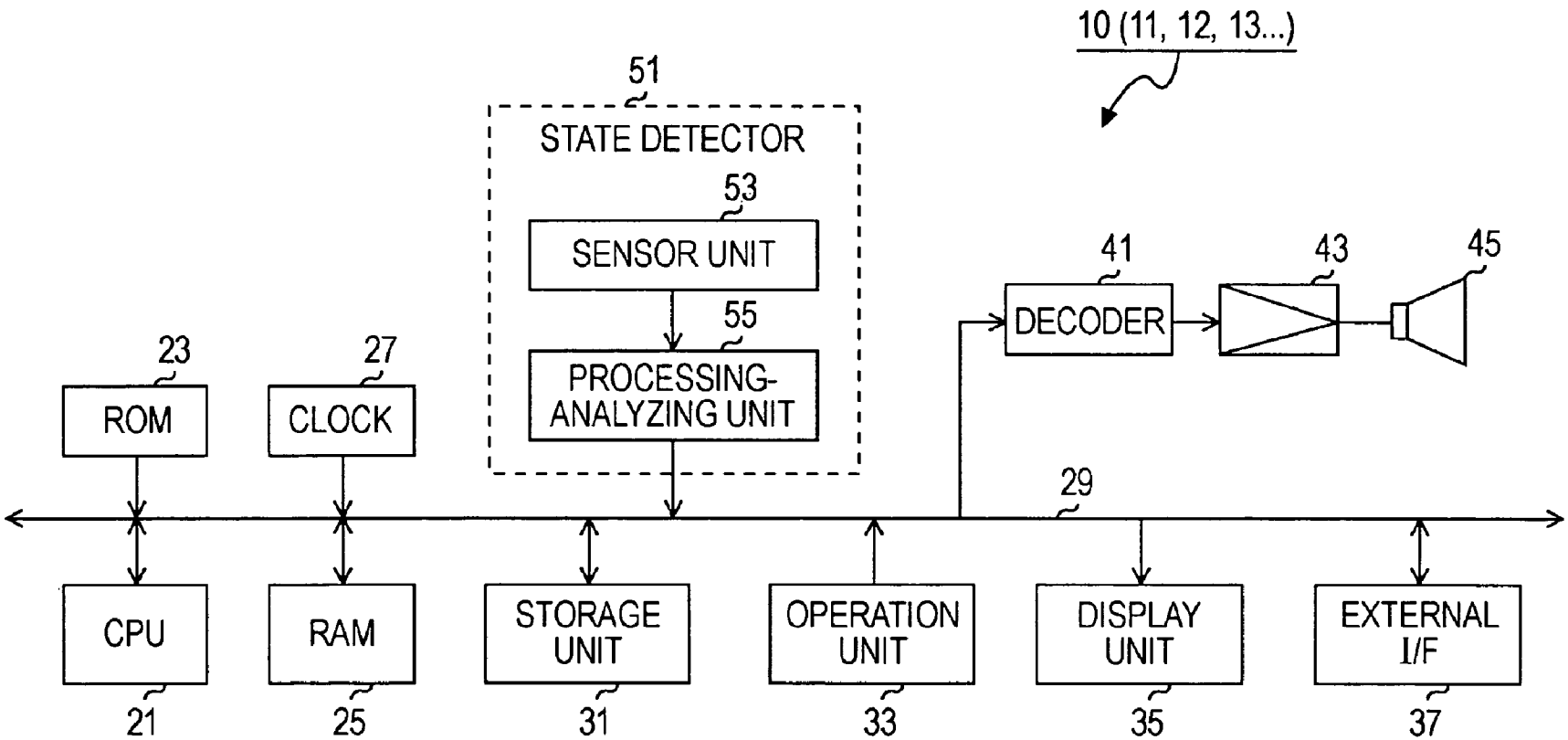
FIG. 2 is a block diagram of an example of a music player according to the embodiment of the present invention.

1-2. Configuration of Music Player: FIG. 2

FIG. 2 shows an example of a music player 10 (11, 12, 13, . . . ) in the case where a portable or stationary apparatus has a function of directly accessing the Internet 1 as in (B) or (C) described above.

The music player 10 in this example includes a central processing unit (CPU) 21. In the music player 10, a read-only memory (ROM) 23 in which various programs, such as programs for detecting a state or generating a log as described later, and data are written, a random-access memory (RAM) 25 in which programs or data are loaded, and a clock 27 are connected to a bus 29.

A storage unit 31, an operation unit 33, a display unit 35, and an external interface 37 are also connected to the bus 29.

The storage unit 31 is an internal storage unit, such as a hard disk or semiconductor memory, or an external storage unit, such as an optical disk or a memory card. In the storage unit 31, music data for a number of pieces of music can be stored and information such as a log can be written.

The operation unit 33 is used by a user for a variety of operations such as ON/OFF of power, starting playback, stopping playback, or controlling volume. The display unit 35 is a liquid crystal display (LCD), a light-emitting diode (LED), or the like, which displays, for example, an operation status or a performance status of the music player 10.

The external interface 37 allows connection to an external network such as the Internet 1.

A sound and speech processing and outputting section, which includes a decoder 41, an amplifier circuit 43 (for sound and speech signals), and headphones (speakers) 45, is also connected to the bus 29. The decoder 41 is for converting data of sound and speech such as data of a piece of music into an analog signal after decompression of the data of sound and speech if compressed.

In addition, to the bus 29, a state detector 51, which includes a sensor unit 53 and a processing-analyzing unit 55, is connected.

The sensor unit 53, such as an acceleration sensor or a video camera, is for detecting the user's state. The processing-analyzing unit 55 processes and analyzes an output signal of the sensor unit 53 after converting the output signal of the sensor unit 53 from an analog signal to digital data, and detects the user's state via classifying the user's state into one of a plurality of patterns as follows.

1-3. User's State and Detection Thereof: FIGS. 3 and 4

1-3-1. Case of User Moving Periodically: FIG. 3

If a user's movement is periodical, such as walking or jogging, a vertical movement of the body, leg movements, arm movements, or the like of the user in motion is detected using, as the sensor unit 53, an acceleration sensor, a distortion sensor, a pressure sensor, or the like.

This enables a signal to be obtained, as an output signal from the sensor unit 53, which changes little by little for a short period of time and periodically as a whole.

That is, in the case where, for example, a user walks, one cycle is from placing the user's left foot (on the ground) to placing the user's right foot (on the ground), or from placing the user's right foot (on the ground) to placing the user's left foot (on the ground).

The cycle of walking means a walking tempo. The shorter the cycle of walking is, the faster the walking tempo becomes. The longer the cycle of walking is, the slower the walking tempo becomes.

The processing-analyzing unit 55 detects a tempo of the user's movement, such as a walking tempo, by processing and analyzing the output signal from the sensor unit 53. For example, a cycle of walking of 600 ms, which means one step corresponds to 600 ms, corresponds to 100 steps per minute, and thus the walking tempo is 100 (steps/min).

The CPU 21 obtains a moving tempo detected, such as a detected walking tempo, from the processing-analyzing unit 55 on the basis of an obtaining cycle with a predetermined period of time, and generates a log.

The obtaining cycle is, for example, 5 seconds. Therefore, if the cycle of walking is approximately 600 ms (the walking tempo is approximately 100) as described above, the obtaining cycle represents more than 8 times the cycle of walking and may detect a plurality of cycles of walking (tempos of walking) within the obtaining cycle. The processing-analyzing unit 55 outputs, as a detection result, an average of the plurality of tempos of walking detected or the walking tempo most recently detected.

In addition, in the case where the user moves periodically as such and the state detector 51 detects the moving tempo, in the music player 10 or the server 100, the user's state is eventually classified into one of the patterns in terms of the detection result, for example, as shown in FIG. 3.

1-3-2. Example of Other State Patterns: FIG. 4

In a case where, for example, three state patterns as a user's state, that is, (a) a state in which movement is small and the user is almost stationary, such as resting;

(b) a state in which movement is moderate; and (c) a state in which movement is large, are to be detected, a video camera, for example, can be used as the sensor unit 53.

In this case, the processing-analyzing unit 55 can determine and detect which one of (a), (b) and (c) a state pattern of the user corresponds to by analyzing video data obtained from the video camera (the sensor unit 53) using a method such as image recognition or motion detection.

In this case as well, the CPU 21 obtains the state pattern detected (a signal indicating which one of (a), (b) and (c) described above the state pattern corresponds to) from the processing-analyzing unit 55 on the basis of an obtaining cycle with a predetermined period of time, and generates a log.

In another case where, for example, two state patterns as a user's state as follows are detected under a condition that, for example, the user is traveling by car:

(d) a state in which a car moves continuously; and (e) a state in which a car hardly moves due to a traffic jam or the like, a velocity sensor, for example, can be used as the sensor unit 53.

In this case, the processing-analyzing unit 55 can determine and detect which one of (d) and (e) described above a moving state of the car, that is, a state pattern of the user, corresponds to by determining whether a detected velocity of an output from the velocity sensor (the sensor unit 53) is greater than or equal to a predetermined threshold value or not.

In this case as well, the CPU 21 obtains the state pattern detected (a signal indicating which one of the above-described (d) and (e) the state pattern corresponds to) from the processing-analyzing unit 55 on the basis of an obtaining cycle with a predetermined period of time, and generates a log.

Furthermore, a user's state can be detected and classified into one of a plurality of patterns as shown in FIG. 4 in accordance with both the state patterns of (a), (b) and (c) described above and those of (d) and (e) described above, if a configuration is as follows: in a case where the user listens to music in a room, a video camera or the like is connected as the sensor unit 53 and the state detector 51 is switched to be in a mode that detects state patterns of (a), (b) and (c) described above; and in a case where the user listens to music in a car, a velocity sensor or the like is connected as the sensor unit 53 and the state detector 51 is switched so as to be in another mode that detects state patterns of (d) and (e) described above.

2. Log, Log Table, and Selection and Recommendation of Piece of Music: FIGS. 5 through 9

Figure 5:
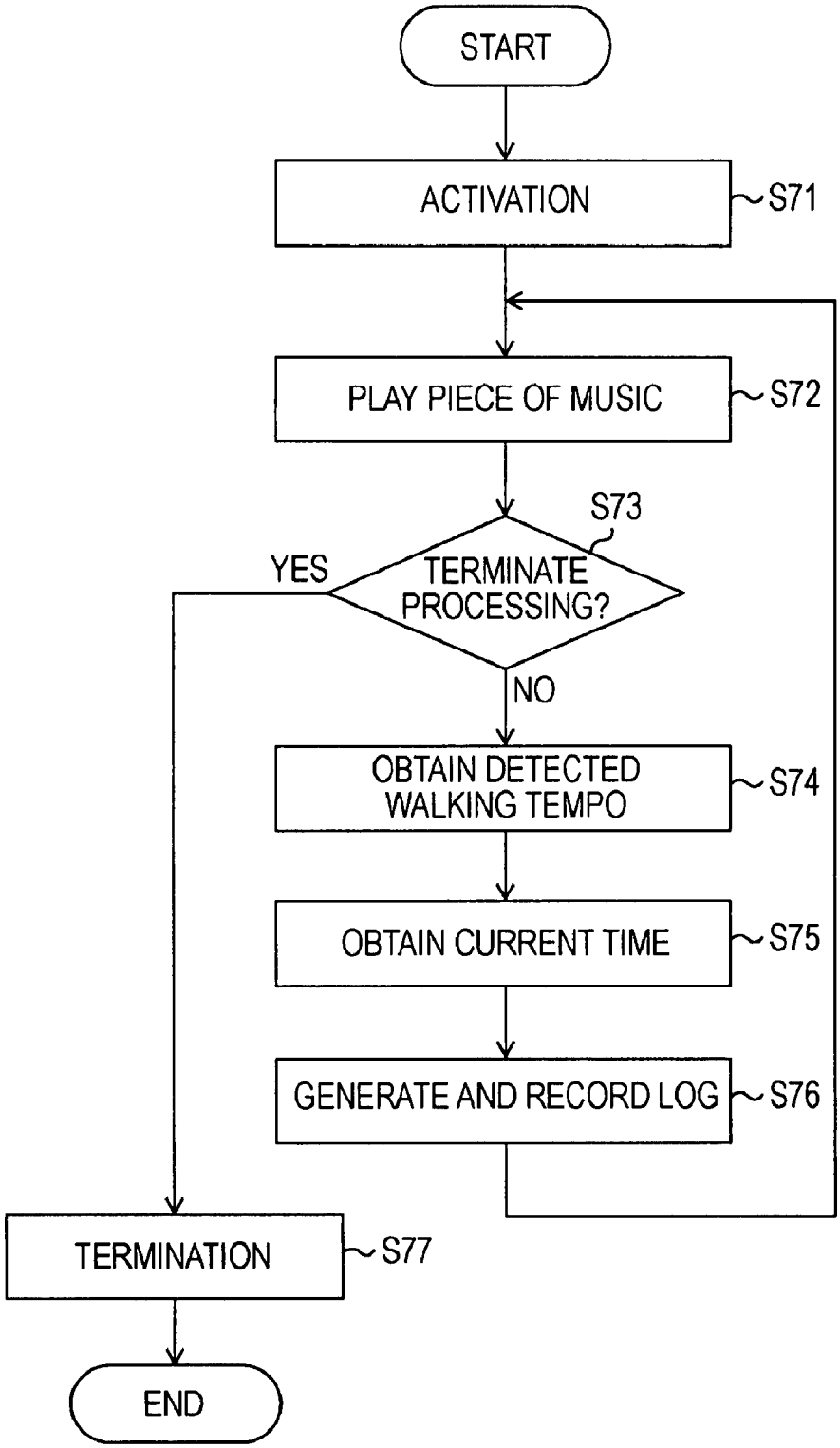
FIG. 5 is a flowchart of a process for detecting a state and generating a log at the music player.

2-1. Log Generation and Sending: FIGS. 5 and 6

In the system as shown in FIG. 1, each user, as a sender (a person who recommends a piece of music), sends the following as a log to the server 100: information indicating the user's state during playback of a piece of music; and information specifying the piece of music.

The information specifying the piece of music can be identification (ID) information, such as an identification code or identification number, if such ID information exists other than bibliographic information such as a title, an artist name, an album title, or the like. If such ID information does not exist, the information specifying the piece of music can be any combination of the title, the artist name, the album title, and the like.

FIG. 5 shows an example of an exemplary process performed by the CPU 21 to generate a log in the music player 10 in the case where the state detector 51 detects a walking tempo as a user's state when a piece of music is being played back.

In this example, the CPU 21 starts the process in response to a start-up operation of the user. In step S71, the CPU 21 performs activation, and then, in step S72, the CPU 21 starts playback of the piece of music. In step S73, the CPU 21 determines whether or not to terminate the process.

If it is determined to terminate the process in accordance with, for example, an operation of the user, the flow proceeds from step S73 to step S77, and the process ends after termination is performed. Otherwise, the flow proceeds from step S73 to step S74, and the CPU 21 obtains a detected walking tempo from the state detector 51 as described above.

After obtaining the detected walking tempo in step S74, the CPU 21 obtains a current time from the clock 27 in step S75. In step S76, the CPU 21 generates a log as described below and then stores the log in the RAM 25 or the storage unit 31. The process returns to step S72 in which playback of the piece of music is continued.

A detected walking tempo is obtained in step S74, current time is acquired in step S75 and a log is generated and stored in step S76, for example, every five seconds, which is an example of the obtaining cycle.

FIG. 6 shows an example of a log. In this example, a log includes a user ID, acquired date and time (the current time obtained in step S75), a walking tempo (the detected walking tempo obtained in step S74), a title, a playback position (a position at which a piece of music is currently being played back at the acquired date and time), an artist name, and an album title.

In a case where a piece of music is played back for a few minutes, a log like the one shown in FIG. 6 is generated and stored a number of times in a state where acquired date and time, a playback position, and a walking tempo are variable.

In this case, the entirety of a number of logs generated can be sent from the music player 10 to the server 100 and consolidated into a single log at the server 100; however, an amount of data to be transmitted can be reduced by sending a single consolidated log from the music player 10 to the server 100.

When a single log that is generated by consolidating a plurality of logs for the same piece of music in the same occasion is sent from the music player 10 to the server 100, for example, acquired date and time may be changed to consolidation date and time or sending date and time, a playback position may be eliminated, and a walking tempo may be set to an average of walking tempos in the plurality of logs.

Here, a walking tempo may be converted into information indicating a state pattern in accordance with the patterns shown in FIG. 3. For example, if an average walking tempo is 85, it is classified to state pattern 2, and also if another average walking tempo is 105, it is classified to state pattern 4.

If the music player 10 includes, as in (A) described above, an apparatus such as a portable music player that can play back a piece of music using music data of the piece of music but does not have a function of accessing the Internet 1 and an apparatus such as a PC with a function of accessing the Internet 1, the user can connect the apparatus such as a portable music player to the apparatus such as a PC and have the apparatus such as a PC consolidate logs as described above after playback of the piece of music is completed.

In the case of classifying the user's state into one of the patterns shown in FIG. 4, during a piece of music being played back for a few minutes, if some change in the user's state occurs, such as changing from state pattern 1 to state pattern 2 or changing from state pattern 5 to state pattern 4, for example, both logs before and after the change are generated and then sent to the server 100 to be consolidated. Alternatively, for example, a log indicating a state pattern lasting for a longer period of time (if the user's state for the first two minutes from the beginning of the piece of music is classified to state pattern 5 and the user's state for the next one minute is classified to state pattern 4, state pattern 5 is chosen) is generated and sent as a consolidated log to the server 100.

In addition, upon generating and sending a log described above, the user can add accompanying information such as the user's experience or comment as described later to the log, and send the log to the server 100.

2-2. Log Table Generation: FIGS. 7 and 8

Since logs are sent from each of the users to the server 100 as described above, the logs are collected in the server 100 to generate a log table and the log table is recorded in the database 102.

FIG. 7 shows an example of a log table generated in the server 100 in a case where a walking tempo T is detected as a user's state and the user's state is classified into one of the patterns as shown in FIG. 3.

In the log table of the example shown in FIG. 7, the following is recorded:

(a) pieces of music A, B and C played back in the case of state pattern 1 ($T<80$);
(b) a piece of music D played back in the case of state pattern 2 ($80 \leqq T<90$);
(c) pieces of music E and F played back in the case of state pattern 3 ($90 \leqq T<100$);
(d) a piece of music G as played back in the case of state pattern 4 ($100 \leqq T<110$); and
(e) pieces of music B, G and H played back in the case of state pattern 5 ($110 \leqq T$).

Frequency of occurrence denotes the number of logs received for each pair of a state pattern and a piece of music. "Yes" or "No" of accompanying information indicates whether the accompanying information as described above is attached to the log or not.

For example, accompanying information #1 from a user, which is attached to a log indicating that the user was listening to the piece of music A while the user's state was that of state pattern 1 ($T<80$), or accompanying information #2 from another user, which is attached to a log indicating that the user was listening to the piece of music B while the user's state was that of state pattern 5 ($110 \leqq T$), may be one of the following:

"This piece of music is perfect for walking to lose weight!";

"I lost 5 kg by listening to this piece of music";

"Let's lose weight together while listening to this piece of music";

"Walking at this speed makes me feel comfortable physically and mentally while listening to this piece of music"; and the like.

In the server 100, a received log and accompanying information are immediately written into the log table, and logs and accompanying information for which a predetermined number of days since reception date and time thereof have passed are deleted from the log table.

FIG. 8 shows another example of a log table generated in the server 100 in a case where users' states are each classified into one of the patterns as shown in FIG. 4 and detected.

In the log table of the example in FIG. 8, the following is recorded:

(a) pieces of music A, B and C played back in the case of state pattern 1 of FIG. 4;
(b) a piece of music D played back in the case of state pattern 2 of FIG. 4;
(c) pieces of music E and F played back in the case of state pattern 3 of FIG. 4;
(d) a piece of music G played back in the case of state pattern 4 of FIG. 4; and
(e) pieces of music B, G and H played back in the case of state pattern 5 of FIG. 4.

As in the example of FIG. 7, frequency of occurrence denotes the number of logs received for each pair of a state pattern and a piece of music. "Yes" or "No" of accompanying information indicates whether the accompanying information as described above is attached to the log or not.

For example, accompanying information #3 from a user, which is attached to a log indicating that the user was listening to the piece of music A while the user's state was that of state pattern 1 (a state in which movement is small and the user is almost stationary, such as resting), is "Resting with this piece of music on relaxes me" or the like. For example, accompanying information #4 from another user, which is attached to a log indicating that the user was listening to the piece of music B while the user's state was that of state pattern 5 (a state in which a car is almost stationary due to, for example, a traffic jam), is "If this piece of music is on, even a traffic jam does not make me irritated" or the like.

In the example of FIG. 8 as well, the server 100 immediately writes a received log and accompanying information into the log table, and deletes logs and accompanying information for which a predetermined number of days since reception date and time thereof have passed from the log table.

Figure 9:
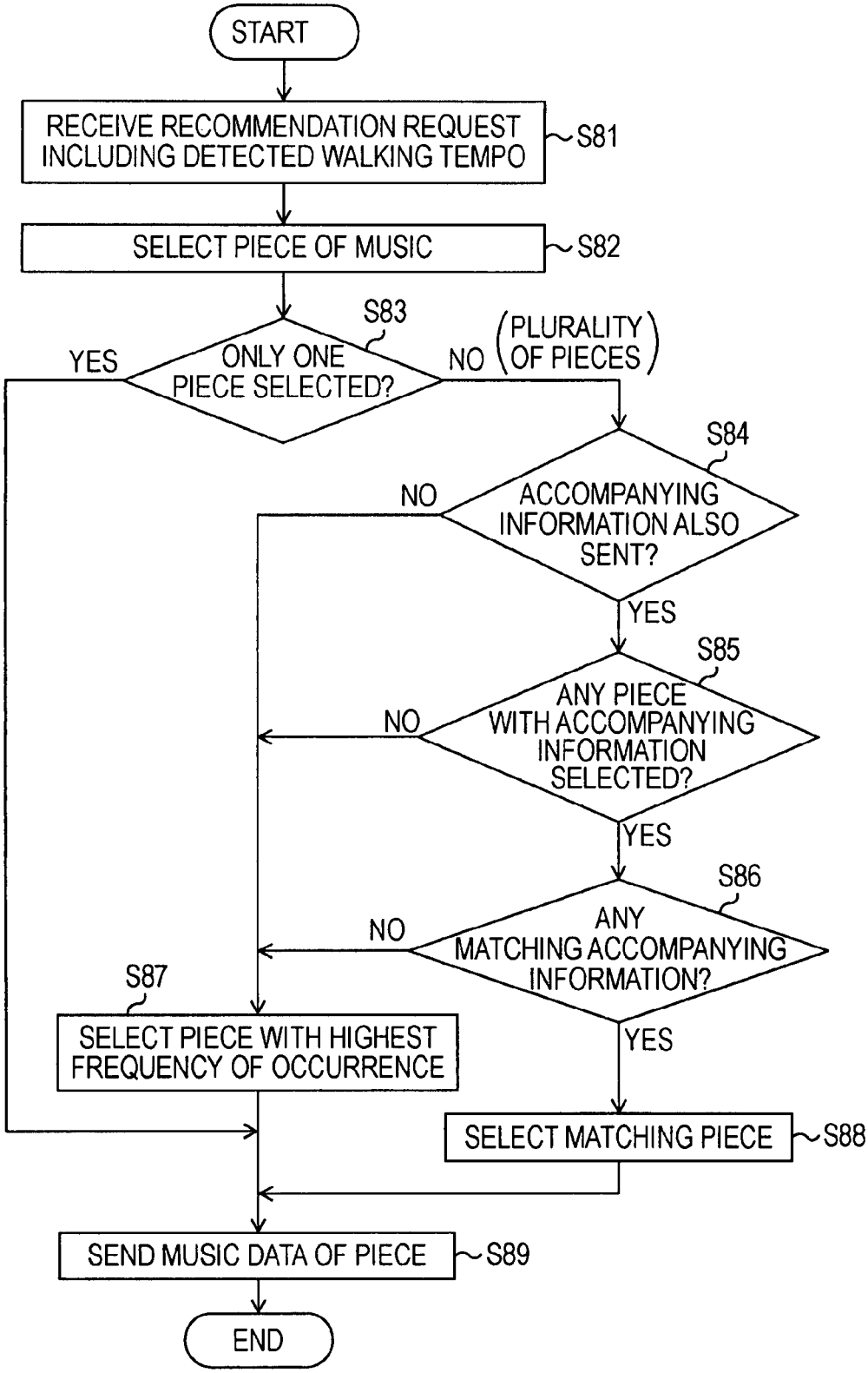
FIG. 9 is a flowchart of a process for selecting and recommending a piece of music in a server.

2-3. Selection and Recommendation of Piece of Music: FIG. 9

Furthermore, in the system shown in FIG. 1, each of the users can be a receiver (a person who receives a recommended piece of music) and send a request for a recommendation of a piece of music to the server 100. In this case, a state detection signal output from the state detector 51 is sent from the music player 10 to the server 100.

For example, when a user is walking at a certain tempo and wants to listen to a piece of music that suits the user's state, the user sends a request for detecting the user's state and a recommendation request to the music player 10. Consequently, the CPU 21 activates the state detector 51 to detect the user's walking tempo at the time, obtains a walking tempo detected as a result, generates a recommendation request including the detected walking tempo, and send the recommendation request to the server 100.

The recommendation request may include a single detected walking tempo. In addition, the user can attach accompanying information including the user's desire or the like to the recommendation request and send the recommendation request with the accompanying information to the server 100. The accompanying information is, more specifically, information such as "Is there any piece of music effective for losing weight?" or "I want to listen to a piece of music that makes me feel comfortable physically and mentally."

If the server 100 receives a recommendation request as such, the server 100 selects a piece of music appropriate for the user's recommendation request and recommends the piece of music to the user who made the request.

For example, if a detected walking tempo is 95, pieces of music E and F are selected as recommendation candidates; however, the piece of music E has a higher frequency of occurrence than the piece of music F, and thus the piece of music E is selected and recommended.

If a detected walking tempo is 75, pieces of music A, B and C are selected as recommendation candidates. Since the piece of music C has the highest frequency of occurrence among the pieces of music A, B and C, the piece of music C is usually selected; however, if accompanying information is included in the recommendation request from the user and the accompanying information included in the recommendation request matches the accompanying information #1 attached to the piece of music A in the case of FIG. 7, the piece of music A will be selected.

For example, if the accompanying information #1 attached to the piece of music A is "I lost 5 kg with this piece of music" and the accompanying information included in the recommendation request is "Is there any piece of music effective for losing weight?", these two pieces of information are determined to match in terms of content.

As a form of recommendation, the server 100 sends music data of the selected piece of music to a music player that sent a request. In this case, the music player that sent a request can play back the piece of music, which is selected and recommended, in streaming playback or the like.

As another form of recommendation, in a system in which music data of a large number of pieces of music, each of which could be recommended, are recorded in the storage unit 31 in the music player 10 of each user, the server 100 sends information specifying the selected piece of music such as ID information of the selected piece of music, to the music player that sent a request. In this case, the music player that sent a request reads the music data of the selected and recommended piece of music from the storage unit 31 and plays back the selected and recommended piece of music.

FIG. 9 shows an exemplary process performed by the control unit 101 in the server 100 for selecting and recommending a piece of music in the above-described case. In the processing for selecting and recommending a piece of music of this example, in step S81, the process receives a recommendation request including a detected walking tempo, which has been sent from a music player of a user. In step S82, the process selects at least one piece of music as a recommendation candidate, which is appropriate for the detected walking tempo included in the recommendation request, from the log table as shown in FIG. 7.

In step S83, the process determines whether more than one selected piece of music exists. As in the case of FIG. 7 where the detected walking tempo included in the recommendation request is 85 or 105, if one piece of music has been selected as a recommendation candidate in step S82 (the piece of music D is selected when the detected walking tempo is 85 and the piece of music G is selected when the detected walking tempo is 105), the process proceeds from step S83 to step S89 and sends music data of the selected piece of music to the music player that sent the request.

In contrast, as in the case of FIG. 7 where the detected walking tempo included in the recommendation request is 75, 95 or 115, if a plurality of pieces of music are detected as recommendation candidates in step S82 (the pieces of music A, B and C are selected when the detected walking tempo is 75, the pieces of music E and F are selected when the detected walking tempo is 95, and the pieces of music B, G and H are selected when the detected walking tempo is 115), the process proceeds from step S83 to step S84 and determines whether or not accompanying information is also sent (whether accompanying information is included in the recommendation request).

If no accompanying information has been sent, the process proceeds from step S84 to step S87 and selects a piece of music with the highest frequency of occurrence among the plurality of pieces of music selected as recommendation candidates. The process further proceeds to step S89 and sends music data of the selected piece of music to the music player that sent the request.

If the accompanying information has been sent (included), the process proceeds from step S84 to step S85 and determines whether or not there is any piece of music to which accompanying information is attached among the plurality of pieces of music selected as recommendation candidates.

As in the case of FIG. 7 where the pieces of music E and F are selected as recommendation candidates, if there is no piece of music to which accompanying information is attached among the plurality of pieces of music selected as recommendation candidates, the process proceeds from step S85 to step S87 and selects a piece of music with the highest frequency of occurrence from among the plurality of pieces of music selected as recommendation candidates. The process further proceeds to step S89 and sends music data of the selected piece of music to the music player that sent the request.

In contrast, as in the case of FIG. 7 where the pieces of music A, B and C or the pieces of music B, G and H are selected as recommendation candidates, if there is at least one piece of music to which accompanying information is attached among the plurality of pieces of music selected as recommendation candidates, the process proceeds from step S85 to step S86 and determines whether or not accompanying information attached to the piece of music, such as the accompanying information #1 or #2 described above, matches the accompanying information included in the recommendation request in terms of content.

If both pieces of the accompanying information do not match in terms of content, the process proceeds from step S86 to step S87 and selects a piece of music with the highest frequency of occurrence from among the plurality of pieces of music selected as recommendation candidates. The process further proceeds to step S89 and sends music data of the selected piece of music to the music player that sent the request.

In contrast, if both pieces of the accompanying information match in terms of content, the process proceeds from step S86 to step S88 and selects a piece of music, to which accompanying information matched in terms of content is attached. The process further proceeds to step S89 and sends music data of the selected piece of music to the music player that sent the request.

Note that if there are a plurality of pieces of music with the highest frequency of occurrence, one of the plurality of pieces of music is selected in step S87 at random, for example. In like manner, in step S88, if there are a plurality of pieces of music to which the accompanying information matched in terms of content is attached, one of the plurality of pieces of music is selected at random, for example.

The above concerns a case where a walking tempo is detected as a user's state in the music player 10 and a piece of music appropriate for the detected walking tempo is selected in and recommended from the server 100; however, another case where one of state patterns 1 through 5 shown in FIG. 4 is detected as a user's state and a recommendation request including a detection result thereof is sent from the music player 10 to the server 100 is similar to the case above.

3. Other Examples or Embodiments

3-1. User Grouping or the Like

The examples described above concern cases where a common log table as shown in FIG. 7 or FIG. 8 is generated for each of the users (for all users); however, a log table for each of a plurality of predetermined user groups may be generated. When a recommendation request is sent from a user, a piece of music may be selected and recommended from a log table of a user group to which the user who sent the recommendation request belongs.

Furthermore, a log table for each of a plurality of users may be generated. When a recommendation request is sent from a user, a piece of music may be selected and recommended from a log table of the user who sent the recommendation request.

3-2. State of User as Sender Generating Log

The examples described above are the cases where the state detection signal obtained from the state detector 51 of the music player 10 is regarded as information indicating a user's state when each of a plurality of users serving as a sender (who recommends a piece of music) sends a log to the server 100. When each user serving as a sender (who recommends a piece of music) sends a log to the server 100, the user may select a piece of music by operating the operation unit 33 in the music player 10 and input information, such as "the walking tempo is about 105", as the user's state when the piece of music is played back.

3-3. Pieces of Content Other Than Music

Furthermore, the examples described above are the cases where pieces of contents are music (pieces of music); however, the present invention may be applied to pieces of content such as still images, moving images, publications, sound and speech other than music (oral narratives such as fairy tales), and may obtain similar advantages as in the case where pieces of content are music.

It should be understood by those skilled in the art that various modifications, combinations, sub-combinations, and alterations may occur depending on design requirements and other factors insofar as they are within the scope of the appended claims or the equivalents thereof.

What is claimed is:

1. A content selecting and recommending method comprising:

receiving, from terminals of a plurality of users via a communication network, a plurality of logs, each of the plurality of logs identifying a piece of content of a plurality of pieces of content and indicating a state of a user of the plurality of users during playback of the piece of content;

classifying the state of the user indicated in each of the plurality of logs into a state pattern of a plurality of state patterns;

generating a log table indicating correspondence between each of the plurality of state patterns and at least one of the plurality of pieces of content, based on the plurality of logs received from the terminals of the plurality of users;

receiving a content recommendation request from a terminal of a requesting user via the communication network, the content recommendation request indicating a state of the requesting user;

classifying the state of the requesting user indicated in the content recommendation request into a first state pattern of the plurality of state patterns;

selecting a first piece of content of the plurality of pieces of content to recommend to the requesting user based on the log table indicating that the first piece of content was played more frequently than a second piece of content by one or more other users while in a state corresponding to the first state pattern; and sending a recommendation of the first piece of content to the terminal of the requesting user.

2. The content selecting and recommending method according to claim 1, wherein:

the generating comprises generating a different log table for each of a plurality of predetermined user groups; and the first piece of content is selected based on the log table of a user group of the plurality of predetermined user groups to which the requesting user belongs.

3. The content selecting and recommending method according to claim 1, wherein the selecting comprises selecting a piece of content having a highest frequency of occurrence among a plurality of pieces of content for which the log table indicates a correspondence with a state pattern of the plurality of state patterns corresponding to the state of the requesting user.

4. The content selecting and recommending method according to claim 1, wherein the selecting comprises selecting, from among a plurality of pieces of content for which the log table indicates a correspondence with a state pattern of the plurality of state patterns corresponding to the state of the requesting user, a piece of content having content accompanying information that matches request accompanying information included in the content recommending request.

5. The content selecting and recommending method according to claim 1, wherein the sending comprises sending content data of the first piece of content to the terminal of the requesting user.

6. The content selecting and recommending method according to claim 1, wherein the sending comprises sending information identifying the first piece of content to the terminal of the requesting user.

7. A server comprising:

a storage unit including a database;

interface means for:

receiving, from terminals of a plurality of users via a communication network, a plurality of logs, each of the plurality of logs identifying a piece of content of a plurality of pieces of content and indicating a state of a user of the plurality of users during playback of the piece of content, and receiving a content recommendation request from a terminal of a requesting user via the communication network, the content recommendation request indicating a state of the requesting user; and control means for:

classifying the state of the user indicated in each of the plurality of logs into a state pattern of a plurality of state patterns, generating a log table indicating correspondence between each of the plurality of state patterns and at least one of the plurality of pieces of content, based on the plurality of logs received by the interface means, classifying the state of the requesting user indicated in the content recommendation request into a first state pattern of the plurality of state patterns, selecting a first piece of content of the plurality of pieces of content to recommend to the requesting user based on the log table indicating that the first piece of content was played more frequently than a second piece of content by one or more other users while in a state corresponding to the first state pattern, and sending a recommendation of the first piece of content to the terminal of the requesting user in response to reception of the content recommendation request by the interface means.

8. A content playback apparatus comprising:

playback means for playing back a piece of content using content data of the piece of content;

state detection means for detecting a physical movement state of a user;

communication means for sending and receiving information; and control means for:

generating a log identifying the piece of content and indicating a physical movement state of the user detected by the state detection means during the playback of the piece of content, sending the log by the communication means to a server, wherein the server is configured to maintain a record of physical movement states of a plurality of users during playback of the piece of content, generating a content recommendation request that indicates a physical movement state of the user detected by the state detection means, and sending the content recommendation request by the communication means to the server wherein the server is configured to recommend a first piece of content based on a record indicating that the first piece of content was played more frequently than a second piece of content by the plurality of users in physical movement states similar to the physical movement state of the user.

9. A content recording apparatus comprising:

storage means for storing information;

state detection means for detecting a physical movement state of a user;

communication means for sending and receiving information; and control means for:

generating a log identifying a piece of content and indicating a physical movement state of the user detected by the state detection means during playback of the piece of content, sending the log by the communication means to a server, wherein the server is configured to maintain a record of physical movement states of a plurality of users during playback of the piece of content, generating a content recommendation request that indicates a physical movement state of the user detected by the state detection means, sending the content recommendation request by the communication means to the server, wherein the server is configured to recommend a first piece of content based on a record indicating that the first piece of content was played more frequently than a second piece of content by the plurality of users in physical movement states similar to the physical movement state of the user, and recording into the storage means content data of the recommended piece of content received by the communication means.

10. A recording medium storing a program product comprising program code for selecting and recommending a piece of content in response to a content recommendation request from a terminal of a requesting user, the program code allowing a computer to function as:

means for receiving, from terminals of a plurality of users via a communication network, a plurality of logs, each of the plurality of logs identifying a piece of content of a plurality of pieces of content and indicating a state of a user of the plurality of users during playback of the piece of content;

means for classifying the state of the user indicated in each of the plurality of logs into a state pattern of a plurality of state patterns;

means for generating a log table indicating correspondence between each of the plurality of state patterns and at least one of the plurality of pieces of content, based on the plurality of logs received from the terminals of the plurality of users;

means for receiving a content recommendation request from a terminal of a requesting user via the communication network, the content recommendation request indicating a state of the requesting user;

means for classifying the state of the requesting user indicated in the content recommendation request into a first state pattern of the plurality of state patterns;

means for selecting a first piece of content of the plurality of pieces of content to recommend to the requesting user based on the log table indicating that the first piece of content was played more frequently than a second piece of content by one or more other users while in a state corresponding to the first state pattern; and means for sending a recommendation of the first piece of content to the terminal of the requesting user.

11. A server comprising:

a storage unit including a database;

an interface to:

receive, from terminals of a plurality of users via a communication network, a plurality of logs, each of the plurality of logs identifying a piece of content of a plurality of pieces of content and indicating a state of a user of the plurality of users during playback of the piece of content, and receive a content recommendation request from a terminal of a requesting user via the communication network, the content recommendation request indicating a state of the requesting user; and a controller to:

classify the state of the user indicated in each of the plurality of logs into a state pattern of a plurality of state patterns, generate a log table indicating correspondence between each of the plurality of state patterns and at least one of the plurality of pieces of content, based on the plurality of logs received by the interface, classify the state of the requesting user indicated in the content recommendation request into a first state pattern of the plurality of state patterns;

select a first piece of content of the plurality of pieces of content to recommend to the requesting user based on the log table indicating that the first piece of content was played more frequently than a second piece of content by one or more other users while in a state corresponding to the first state pattern, and send a recommendation of the first piece of content to the terminal of the requesting user in response to reception of the content recommendation request by the interface.

12. A content playback apparatus comprising:

a playback unit to play back a piece of content using content data of the piece of content;

a state detector operable to detect a physical movement state of a user;

a communication unit; and a controller operable to:

generate a log identifying the piece of content and indicating a physical movement state of the user detected by the state detector during playback of the piece of content, send the log by the communication unit to a server, wherein the server is configured to maintain a record of physical movement states of a plurality of users during playback of the piece of content, generate a content recommendation request indicating a physical movement state of the user detected by the state detector, and send the content recommendation request by the communication unit to the server wherein the server is configured to recommend a first piece of content based on a record indicating that the first piece of content was played more frequently than a second piece of content by the plurality of users in physical movement states similar to the physical movement state of the user.

13. A content recording apparatus comprising:

a storage unit;

a state detector operable to detect a physical movement state of a user;

a communication unit; and a controller operable to:

generate a log identifying a piece of content and indicating a physical movement state of the user detected by the state detector during playback of the piece of content, send the log by the communication unit to a server, wherein the server is configured to maintain a record of physical movement states of a plurality of users during playback of the piece of content, generate a content recommendation request indicating a physical movement state of the user detected by the state detector, send the content recommendation request by the communication unit to the server, wherein the server is configured to recommend a first piece of content based on a record indicating that the first piece of content was played more frequently than a second piece of content by the plurality of users in physical movement states similar to the physical movement state of the user, and record into the storage unit content data of the recommended first piece of content received by the communication unit.

14. The content recording apparatus according to claim 13, wherein the physical movement state of the user represents movement of a car in which the user is traveling, and wherein the server is configured to recommend the first piece of content based partly on the movement of the car.

15. A recording medium storing a program product comprising program code for selecting and recommending a piece of content in response to a content recommendation request from a terminal of a requesting user, the program code allowing a computer to function as:

a receiving unit to:

receive, from terminals of a plurality of users via a communication network, a plurality of logs, each of the plurality of logs identifying a piece of content of a plurality of pieces of content and indicating a state of a user of the plurality of users during playback of the piece of content, and receive a content recommendation request from a terminal of a requesting user via the communication network, the content recommendation request indicating a state of the requesting user;

a classifying unit to:

classify the state of the user indicated in each of the plurality of logs into a state pattern of a plurality of state patterns, and classify the state of the requesting user indicated in the content recommendation request into a first state pattern of the plurality of state patterns;

a generating unit to generate a log table indicating correspondence between each of the plurality of state patterns and at least one of the plurality of pieces of content, based on the plurality of logs received by the receiving unit;

a selecting unit to select a first piece of content of the plurality of pieces of content to recommend to the requesting user based on the log table indicating that the first piece of content was played more frequently than a second piece of content by one or more other users while in a state corresponding to the first state pattern; and a sending unit to send a recommendation of the first piece of content to the terminal of the requesting user.

* * * * *